United States Patent [19]

Young et al.

[11] Patent Number: 5,009,330

[45] Date of Patent: Apr. 23, 1991

[54] GOLF BALL VENDING MACHINE

[76] Inventors: Donald R. Young; Ruth L. Young, both of 12859 Honeybrook Dr., Hudson, Fla. 34669

[21] Appl. No.: 462,171

[22] Filed: Jan. 8, 1990

[51] Int. Cl.[5] ..... G07F 11/00

[52] U.S. Cl. ..... 221/196; 221/200; 221/204; 221/236; 221/258; 221/265; 221/296

[58] Field of Search ..... 221/196, 195, 194, 191, 221/205, 204, 200, 265, 264, 263, 258, 296, 298, 289, 236, 290, 297, 299, 301; 312/49; 222/370, 367, 451, 242, 239, 236

[56] References Cited

U.S. PATENT DOCUMENTS

| | | | |
|---|---|---|---|
| 862,923 | 8/1907 | Linsley | 221/296 |
| 2,299,403 | 10/1942 | Mozel | 312/49 |
| 2,653,069 | 9/1953 | Mason | 221/196 X |
| 3,894,657 | 7/1975 | Eckmayr | 221/265 |
| 4,276,750 | 7/1981 | Kawasumi | 221/96 X |
| 4,588,108 | 5/1986 | Knez et al. | 221/68 |
| 4,667,847 | 5/1987 | Tucom | 221/196 X |

*Primary Examiner*—David H. Bollinger

*Attorney, Agent, or Firm*—Joseph C. Mason, Jr.; Ronald E. Smith

[57] ABSTRACT

A machine that vends a predetermined number of golf balls when activated by a coin or token-operated slide mechanism. A large plurality of golf balls are placed in a hopper and the balls are fed from the hopper, one at a time, into an elongate pipe that discharges into a bucket positioned in a chamber near the bottom of the machine. A motor rotates a turntable having golf ball receiving apertures formed in its outer periphery so that the balls fill each aperture as the turntable rotates. The upper end of the pipe is in the path of travel of and is in open communication with apertures formed in the turntable so that rotation of the turntable continuously fills the pipe as the apertures pass over its open end. Numerous structural features, including vibrating members, insure that the balls will not jam in the hopper and additional design features insure a jostling of the balls in the vicinity of the pipe's upper end to insure against jamming at that critical location.

46 Claims, 10 Drawing Sheets

Fig. 12
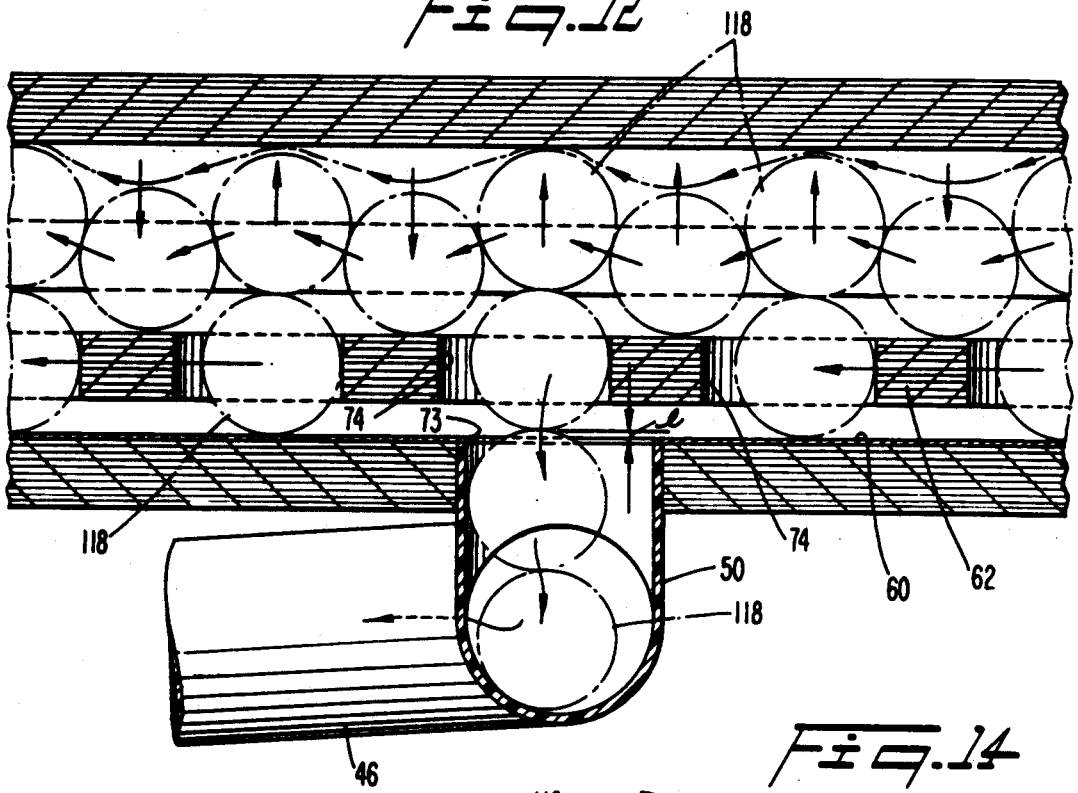
Fig. 14
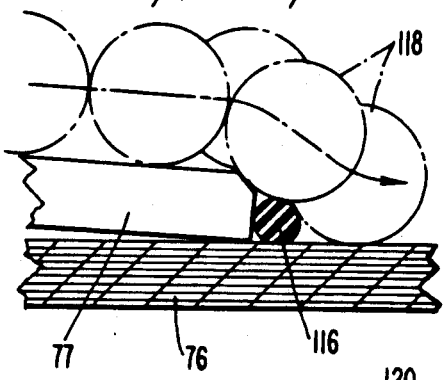
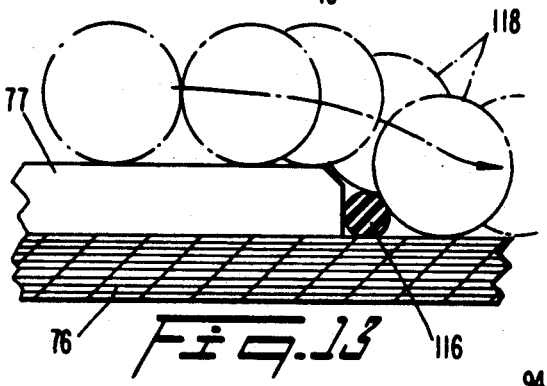
Fig. 13
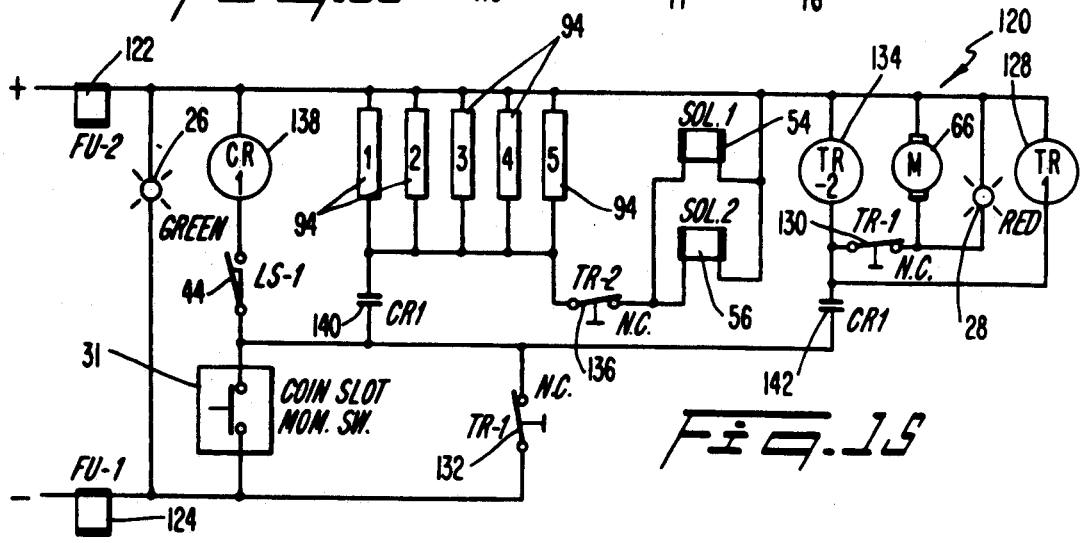
Fig. 15

Fig. 21
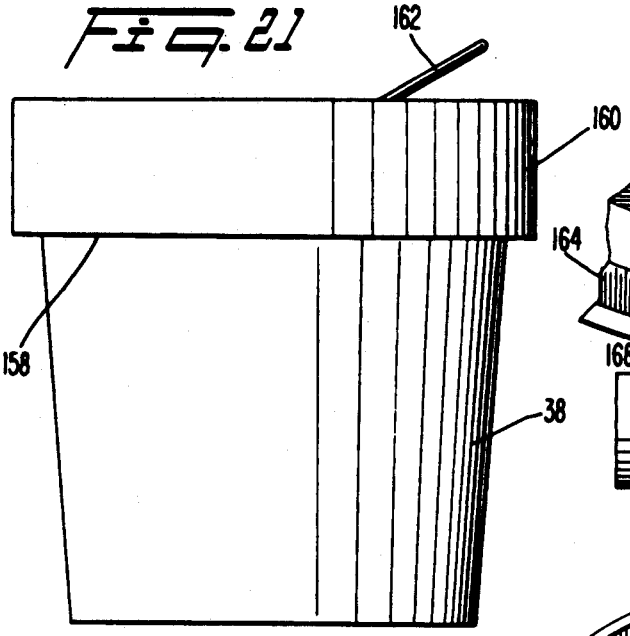
Fig. 24
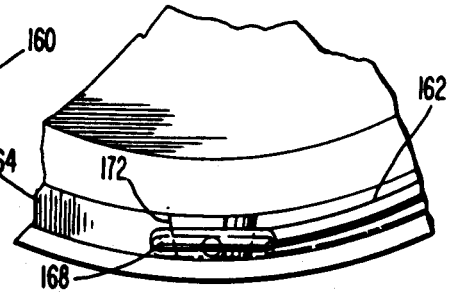
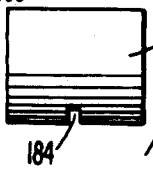
Fig. 28
Fig. 27
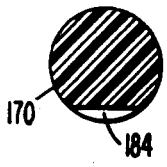
Fig. 26
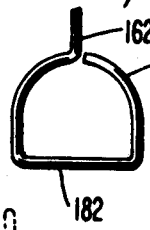
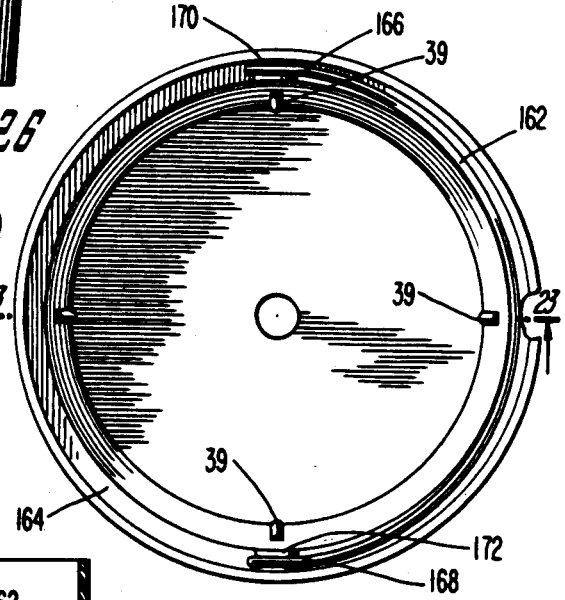
Fig. 22
Fig. 23
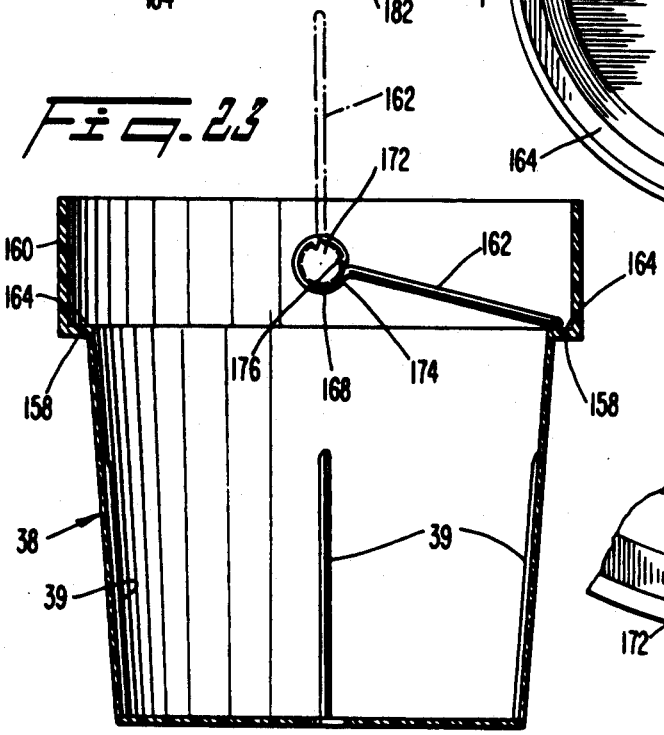
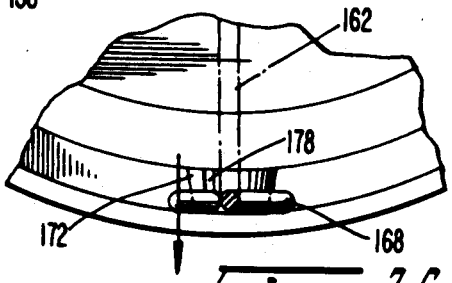
Fig. 25

GOLF BALL VENDING MACHINE

TECHNICAL FIELD

This invention relates, generally, to vending machines. More particularly, it relates to machines that hold a large quantity of golf balls and which vend predetermined numbers thereof upon payment of a predetermined amount.

BACKGROUND ART

Many golfers frequent driving ranges where they can hit a large number of balls in a short period of time. Typically, a golfer will pay for a large bucket or a small bucket of golf balls and take them to a teeing area where the balls can be hit down a driving range. In this manner, the golfer improves his or her driving skills and enjoys the exercise associated with hitting a large number of balls in a relatively short period of time.

Most pro shops are attended by an individual who collects payment for the large bucket or small bucket and hands the large or small bucket to the customer. That individual, or someone else, is usually responsible as well for keeping the buckets filled to their proper level. Obviously, such vending procedure is labor-intensive and cuts deeply into whatever profits may be earned by the proprietor in supplying the service. It is also well known among shop owners that the individual responsible for handling the vending often befriends various customers and sells them large buckets for the price of a small bucket, or gives them a free bucket from time to time, and so on.

Thus, at least one inventor has heretofore made an effort to develop a golf ball vending machine that substantially takes the human element out of the vending process. The device is a combination ball cleaner and vending machine and is shown in U.S. Pat. No. 4,588,108. The balls are washed in a ball washing device and carried while still wet to the vending part of the machine by an escalator-like conveyance means. The machine vends a bucket full of balls in response to a coin or token-activated signal. Apparently, the machine lacks the capacity of vending a small bucket of balls; perhaps more importantly, the machine retails for about $15,000.00 and is of complex construction.

Accordingly, there is a need for a golf ball vending machine of elegant construction that is capable of vending either half a bucket of balls or a full bucket at the election of a consumer, but the prior art neither teaches nor suggests how such an apparatus could be provided.

DISCLOSURE OF INVENTION

The longstanding but heretofore unfulfilled need for an improved golf ball vending machine is now fulfilled by the present invention. An elongate pipe or fill tube has a first, upper end disposed in a vertical disposition, an elongate medial part that generally spirals downwardly therefrom, and a second end disposed in open communication with a vending chamber that holds a bucket. Means are provided for sequentially introducing golf balls into the upper end of the fill tube and a pair of gates are provided along the extent of the tube at preselected locations so that a first gate, when closed, creates a queue of balls extending from said first gate to the second gate and so that the second gate, when closed, creates a queue of balls extending from said second gate to the upper end or beginning of the fill tube. When a coin or token is accepted by the machine, the first gate opens and allows the balls upstream thereof to roll into the bucket under the influence of gravity, thereby filling the bucket halfway. The first gate then closes, and the second gate opens to recharge the first queue so that a consumer desiring a full bucket of golf balls may insert a second coin or token so that the above process can be repeated and the bucket filled. Acceptance by the machine of a coin or token also initiates operation of a motor that rotates a turntable that sequentially delivers golf balls into the upper end of the pipe so that the pipe remains filled.

More particularly, a very large plurality of golf balls, such as several thousand golf balls, are loaded into the top of the machine to prepare it for use. The number of balls that can be charged into the machine could even be in the tens of thousands, because the machine is specifically designed so that virtually no weight bears down on the critical moving part of the inventive assembly, regardless of the number of balls held thereby. The top of the machine serves as a hopper for the balls until they drop, one at a time, into the upper end of the fill tube or pipe that leads to the bucket. The hopper section of the machine has many structural details that feed the balls, sequentially, into the upper end of the pipe, which prevent the balls from jamming, and which keep the weight of the balls off the above-mentioned moving part.

For example, a guide member having a downwardly sloping conical top is positioned in the center of the hopper and distributes the golf balls radially outwardly towards the outer walls of the hopper. A pair of inclined shelf members are also positioned in the hopper; the downward inclination of the shelves allows the balls to roll therefrom, but, more importantly, the shelves provide an air space therebeneath to prevent jamming and they further shield the balls below the shelves from the weight of the balls supported by the shelves.

The bottom or floor of the hopper is also inclined toward the center thereof to continually urge the balls toward the center of the hopper.

A rotatably mounted turntable is mounted substantially flush with the floor of the hopper. It is protected from the weight of balls in the hopper by the guide member. The turntable is a flat disc-like member having a plurality of equidistantly and circumferentially spaced apertures formed about its periphery. The guide members, the downwardly inclined shelf members, and the inclined floor of the hopper, with the aid of gravity, continually urge the balls toward the turntable. The turntable is mounted in the center of the hopper and is freely rotatable about a vertical axis. Since the turntable is substantially flush with the floor of the hopper, the balls will enter the apertures formed in the turntable. Each aperture accommodates one ball only. A motor rotates the turntable, thereby carrying the balls in a circular path of travel. The upper end of the fill tube is positioned in the path of travel of the balls so that they drop into the pipe, one at a time, as the turntable rotates.

A general object of this invention is to provide an improved golf ball vending machine that is reasonably priced.

A more specific object is to provide such a machine that is specifically designed so that it does not jam, i.e., so that golf balls disposed therein will flow freely through the machine at all times.

The invention is new, useful and was not obvious to those of ordinary skill in the art at the time it was made.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which:

FIG. 12 is a detailed view showing the jostling action of the golf balls as they pass over the fill tube when it is full;

FIG. 13 is a detailed view of a part of the structure shown in FIG. 11;

FIG. 14 is a view similar to that of FIG. 13, with a minor structural variation;

FIG. 15 is a schematic diagram of the electrical circuitry that controls operation of the machine;

FIG. 21 is a side elevational view of the preferred embodiment of the bucket that forms a part of the present invention;

FIG. 22 is a top plan view of the bucket shown in FIG. 21;

FIG. 23 is a sectional view taken along line 23—23 in FIG. 22;

FIG. 24 is a detailed plan view of a part of the bucket when the bail is in its stored configuration;

FIG. 25 is a view similar to that FIG. 24, but showing the bail in its in use position;

FIG. 26 shows an alternative configuration of the opposite ends of the bail;

FIG. 27 is a sectional view of an alternative mounting member for the bail; and

FIG. 28 is a side elevational view of the mounting member of FIG. 27.

Similar reference numerals refer to similar parts throughout the several views of the drawings.

BEST MODES FOR CARRYING OUT THE INVENTION

Figure 2:
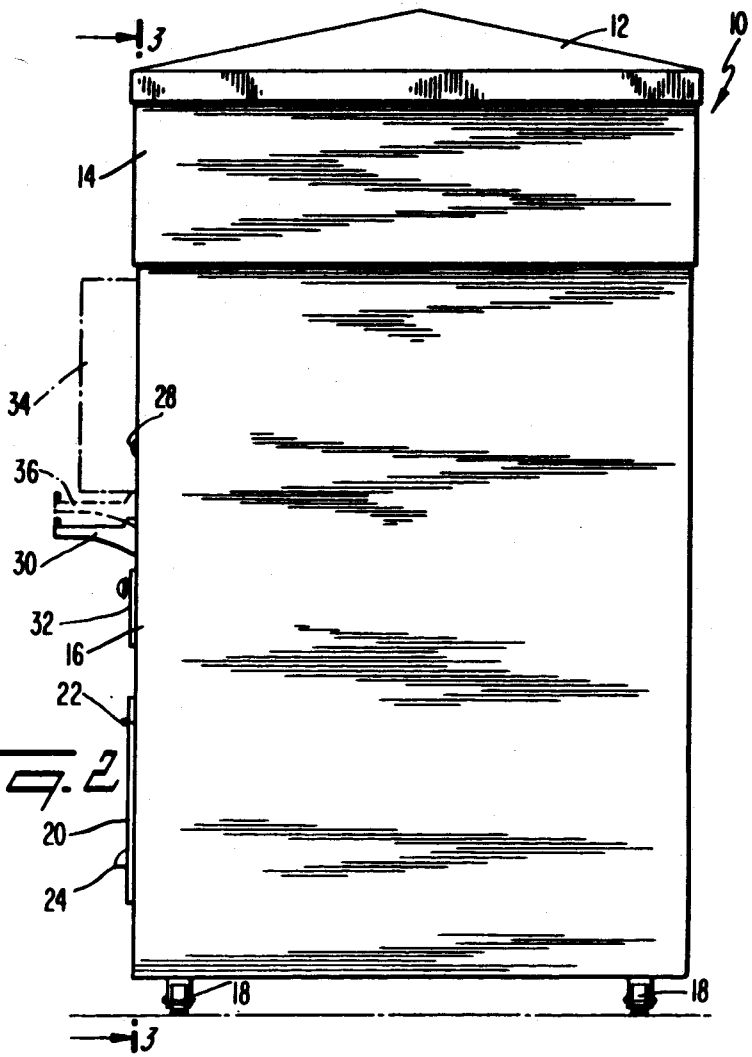
FIG. 2 is a side elevational view thereof.
Figure 1:
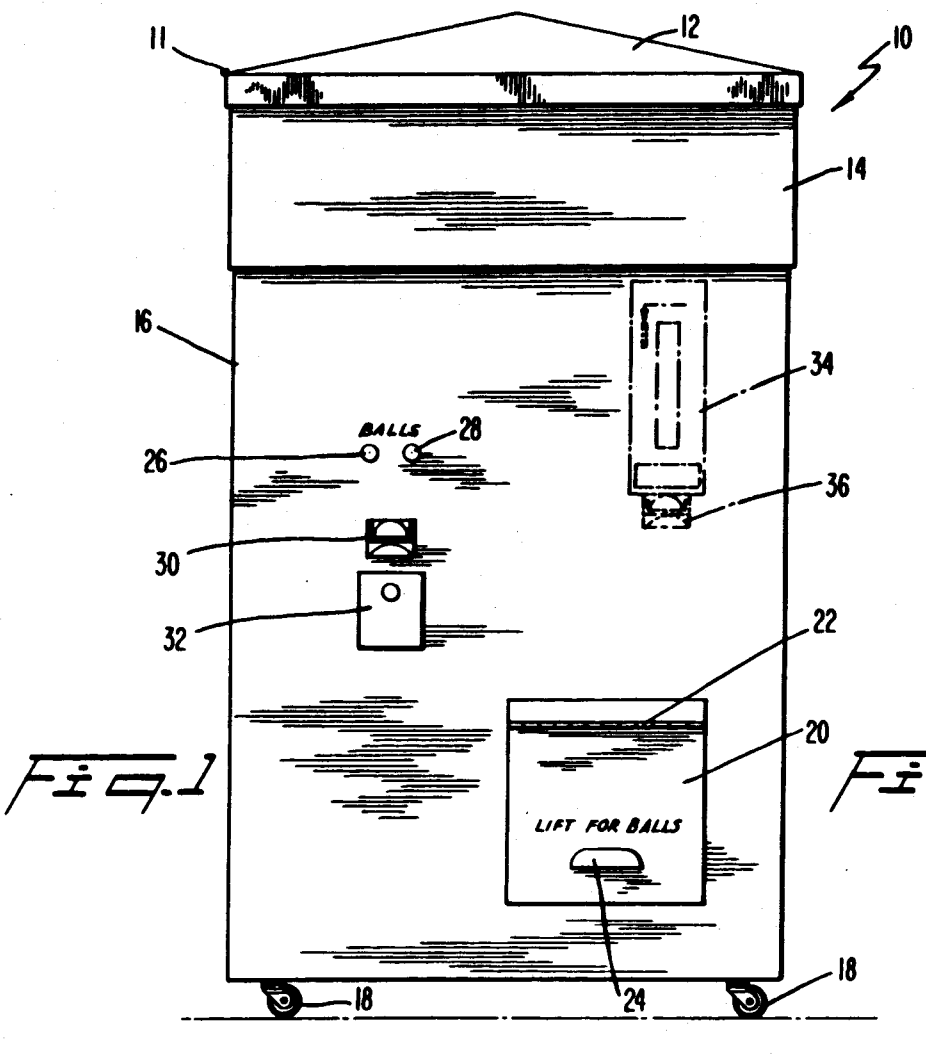
FIG. 1 is a front elevational view of a preferred embodiment of the present invention.

Referring now to FIGS. 1 and 2, it will there be seen that an exemplary embodiment of the present invention is denoted as a whole by the reference numeral 10, generally.

A lid 12 surmounts and releaseably closes hopper 14; said hopper similarly surmounts housing 16 of vending machine 10. Housing 16 is supported by a plurality of caster wheels, collectively denoted 18.

Hinge 11 allows lid 12 to be swung open and key lock 13 on the opposite side of hinge 11 defeats unauthorized opening of lid 12. Additional key locks, also denoted 13, (see FIG. 3) lock opposite sides of the hopper 14 to housing 16. As perhaps best shown in FIG. 3, hopper 14 telescopically receives housing 16. Boards 15 circumscribe the inner walls of the hopper near the lower, open end thereof to provide the needed stop means as shown.

A bucket chamber, not shown in FIGS. 1 and 2, is closed by door 20, having hinges 22; said door is opened and closed by manipulation of handle 24.

A green indicator light 26 at the front of housing 16 is activated when the machine has sufficient golf balls therein to fill a large bucket; a red indicator light 28 indicates that the machine is not full. However, in some cases, a small bucket could still be filled even when the red light is on, as will become clear as this description continues. A coin or token-accepting slide member 30 of conventional construction activates the machine when the user inserts the coins or tokens into the machine by pushing the slide mechanism forwardly in the well known manner. Panel 32 is removable by authorized personnel only to collect the coins or tokens that have been accepted by the machine.

A golf tee dispensing means, generally denoted 34, is shown in phantom lines and a slide-operated coin or token-accepting means 36 is associated therewith. This particular dispensing means forms no part of the invention, per se, and is not otherwise disclosed.

Figure 3:
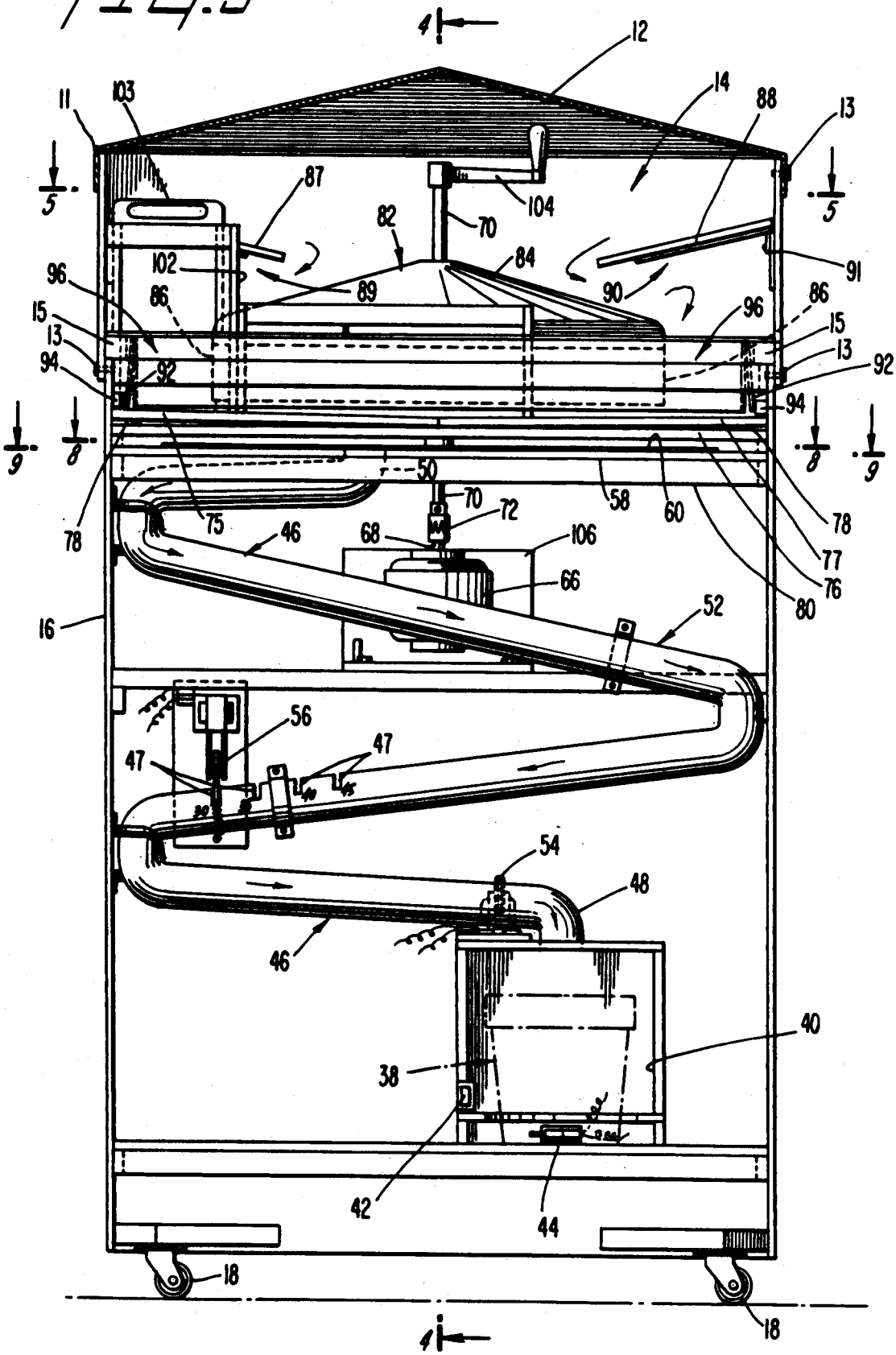
FIG. 3 is a sectional view taken along line 3—3 in FIG. 2.

Referring now to FIG. 3, it will there be seen that bucket 38 is positioned in bucket chamber 40 when the machine is to be used. A magnet 42 on the frame of chamber 40 holds door 20 closed. Bucket switch 44 is positioned at the back of the chamber and is normally open; if no bucket is in chamber 40, machine 10 will not operate.

Golf balls are fed into bucket 38 by an elongate pipe or fill tube 46 that has a lower end 48 in open communication with the bucket chamber, an upper end 50 in open communication with the hopper 14, and a generally spiral in configuration medial part 52. In a preferred embodiment, the pipe 46 holds ninety five balls. Pipe 46 could be made of expandable or telescoping construction to provide different ball storage capacities.

A first gate 54 is disposed near the lowermost end 48 of pipe 46 and a second gate 56 is disposed upstream thereof. As will be shown hereinafter, the gates 54 and 56 are so constructed that when closed, no golf ball can travel therepast, and when opened, no obstacle is presented to the balls in the pipe.

In a preferred embodiment, gates 54 and 56 are spaced such that there are thirty golf balls downstream of gate 56. Before the machine is activated, gate 54 is closed and gate 56 is open. Upon activation, gate 54 opens and gate 56 closes. Thus, in this particular embodiment, thirty balls are immediately dispensed when the machine is activated. Gate 54 remains open about six seconds although the thirty balls upstream thereof will roll out of the tube into the bucket in only two or three seconds. At the end of six seconds, or other preselected period of time, gate 54 closes and gate 56 opens; another thirty balls then fill the space between the gates so that the cycle can repeat when the machine is activated again. Thus, an individual desiring a small or substantially half-filled bucket activates the machine a single time, whereas a person desiring a large or filled bucket activates the machine twice. The same bucket may be used regardless of whether the individual desires a half-filled (small) or completely filled (large) bucket.

The respective cavities of hopper 14 and housing 16 are separated by horizontally disposed partition wall 58, although it should be understood that hopper 14 telescopically receives housing 16 as aforementioned, there being no tools needed to place the hopper atop the housing or to remove it therefrom when locks 13 are unlocked.

Bearing plate 60 overlies and is supported by partition wall 58 and is preferably of thin, metallic construction for reasons that will become clear as this description proceeds. Plate 60 is preferably about 0.062 inches thick.

Figure 4:
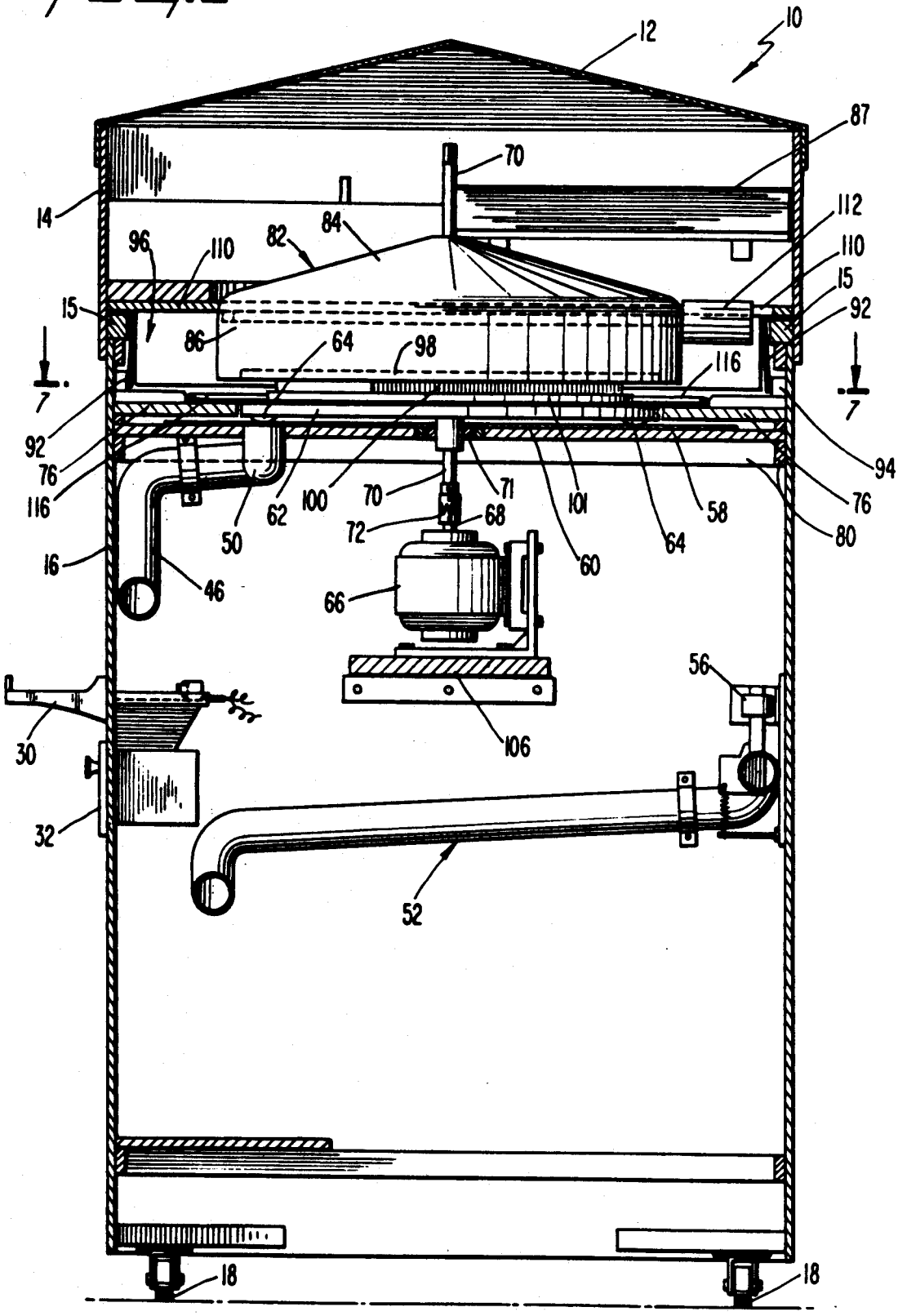
FIG. 4 is a sectional view taken along line 4—4 in FIG. 3.

A disc-shaped turntable 62, best shown in FIG. 4, is in closely vertically spaced relation to bearing plate 60 as shown in said FIG. 4. Turntable 62 is rotatably and freely mounted and is carried by a plurality of equidistantly and circumferentially spaced, rotatably mounted bearing members 64; the bearings 64 are supported by bearing plate 60 as perhaps best shown in FIGS. 4 and 6, and plate 60 is therefore constructed of a heavy, durable metal.

Motor 66 has an output shaft 68 which is coupled to turntable shaft 70 by a coupler 72; thus, turntable 62 rotates at a predetermined number of revolutions per minute when the motor is operating. Shaft 70 rotates in bearings 71, 73 and 75 (FIG. 6), it being understood that partition wall 58, bridge 110, and guide member 82 do not rotate.

Figure 7:
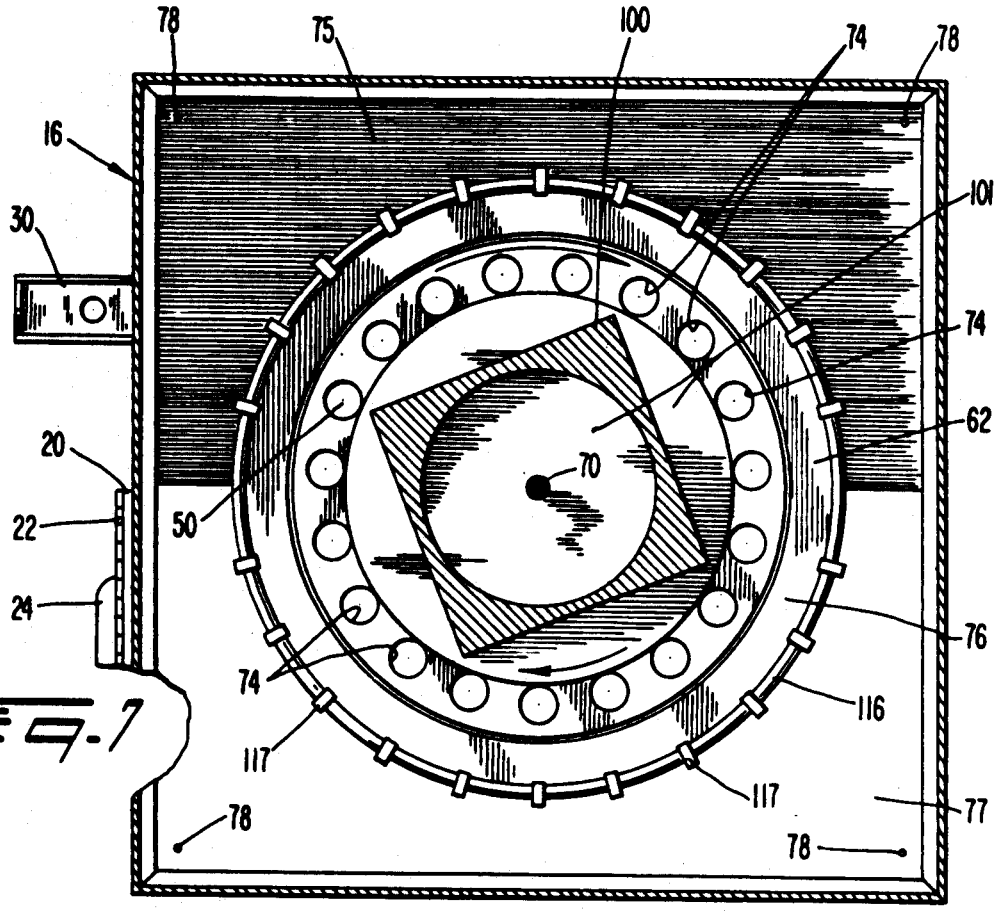
FIG. 7 is a sectional view taken along line 7—7 in FIG. 4.
Figure 8:
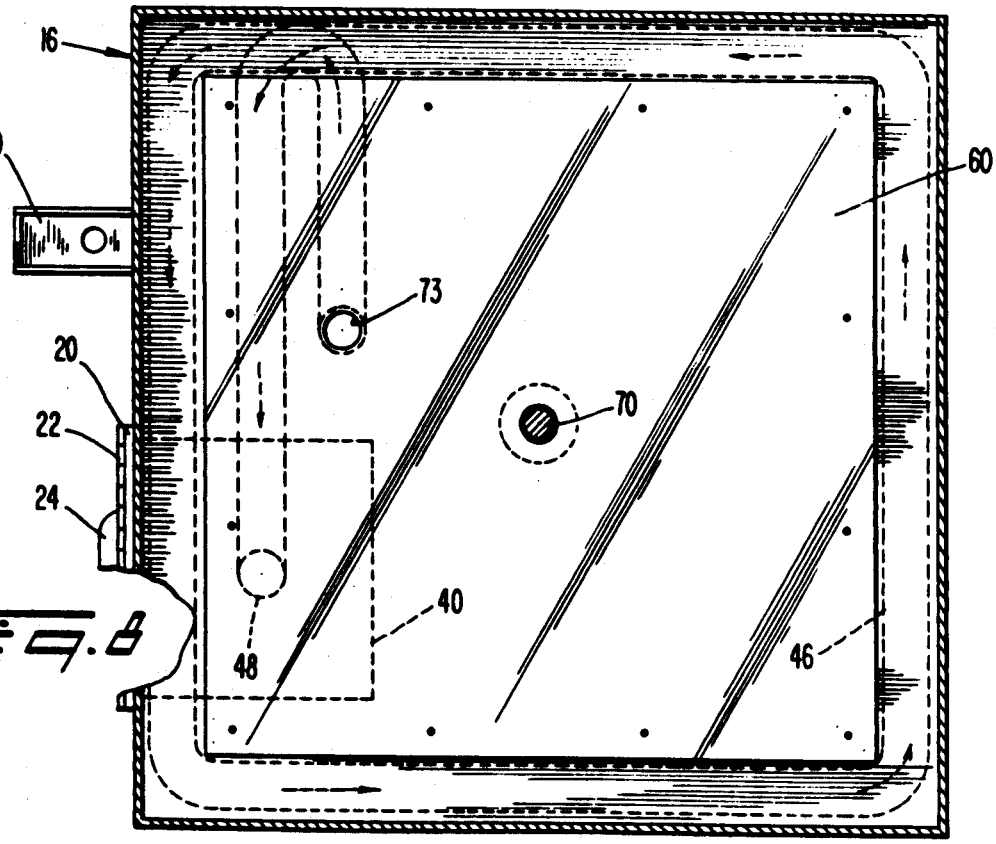
FIG. 8 is a sectional view taken along line 8—8 in FIG. 3.
Figure 9:
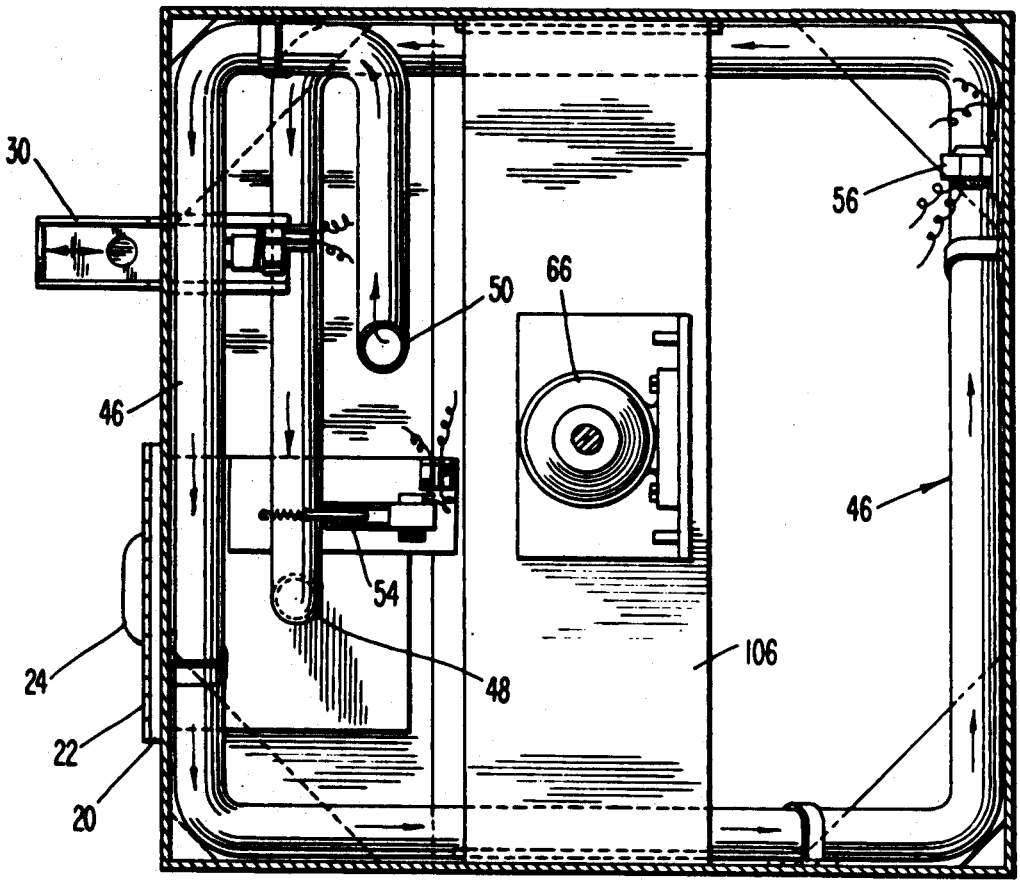
FIG. 9 is a sectional view taken along line 9—9 in FIG. 3.

As perhaps best shown in FIG. 7, a plurality of equidistantly and circumferentially spaced apertures, collectively denoted 74, are formed in turntable 62, about the periphery thereof. Each aperture 74 has a predetermined diameter that is slightly greater than the diameter of a golf ball.

The structural parts to be described hereinafter relate primarily to the means for introducing golf balls into said apertures 74, one ball per aperture, and to the means for preventing jamming of the balls as they are fed into said apertures.

Figure 6:
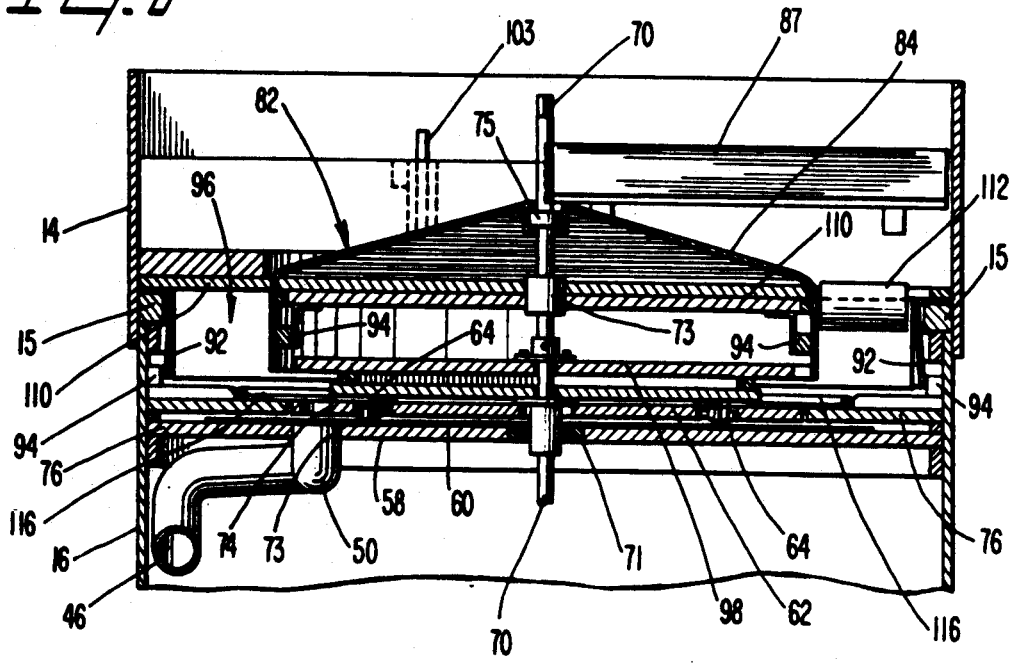
FIG. 6 is a sectional view taken along line 6—6 in FIG. 5.

Importantly, as best depicted in FIG. 6, only one aperture 73 is formed in partition wall 58 and bearing plate 60 and that apertures is in open communication with the upper end 50 of pipe 46. Aperture 73 will hereinafter be referred to as the escape aperture. As turntable 62 rotates, the golf balls carried in apertures 74 sequentially fall, from their individual apertures, through escape aperture 73 into the upper end 50 of pipe or fill tube 46 under the influence of gravity. Thus, when an aperture 74 is vacated because it has passed over the escape aperture 73, said aperture 74 is quickly occupied by another golf ball before it revolves around to the upper end of the pipe and the escape aperture 73 again. In this manner, as long as turntable 62 rotates, a golf ball is dropped into the pipe every time an aperture 74 formed in turntable 62 passes over escape aperture 73. More particularly, in a preferred embodiment, there are nineteen apertures 74 and the turntable rotates six times per minute. Thus, balls enter the pipe 46 at the rate of 114 balls per minute when the turntable is rotating at six rpm, and at the rate of 57 balls per minute at three rpm, and so on. Continued rotation of the motor after fill tube 46 is full presents no problem.

The top of turntable 62 is substantially flush with but does not touch hopper bottom walls 76 as shown in FIG. 4 and other Figs. As best depicted in FIG. 3, bottom wall 76 supports a pair of floor boards 75, 77, and said floorboards are sloped toward the center of hopper 14 as shown to direct balls disposed thereatop toward turntable 62. Plural washer members, not shown, or other suitable spacer members, are placed over locater pins, collectively denoted 78, which are disposed at the outer corners of the floorboards 75, 77 as shown in FIG. 3 to effect the desired downward slope although such slope could be provided in different ways. For example, if machine 10 were formed at least in part of molded parts, the downward slope of the floorboards could be provided in the absence of washers or other spacer means. However, the embodiment shown is specifically designed to be assembled without there being any need for tools and all of the parts are built from stock items such as widely available boards and sheets of plywood. After the subassemblies are made, no tools are needed to assemble or dissemble the novel structure, other than the aforementioned keys for unlocking the lid and the hopper. Thus, many of the small structural details shown in the drawings, such as support members such as partition wall supports 80, e.g., form no part, per se, of the invention since those skilled in the art of machine design can construct a machine by following this disclosure without using the materials and precise structural parts selected by the inventor. Accordingly, the invention is claimed without restriction to such relatively insignificant structural details.

Washers may also be needed to correct for warped boards or metal or to correct for uneven floors or other support surfaces.

Importantly, locater pins 78, of which there are four, serve also to prevent floorboards, 75, 77 from sliding radially inwardly and thereby rubbing against the turntable. Turntable 62 supports no weight other than the few balls atop it and it should be understood that very little torque is required to rotate it. Thus, the locater pins 78 serve the very important function of insuring that floorboards 75, 77 do not rub against said turntable 62. Significantly, turntable 62 rotates freely regardless of the number of balls in hopper 14.

The sloping floorboards 75, 77 are merely one of a number of structural features that insure that the apertures 74 formed in turntable 62 will remain full as the machine operates, i.e., the sloping floorboards provide a gravity feed that continually urges balls toward the turntable. More particularly, there are a number of additional major structural features that both feed balls to the turntable and which prevent jamming of the balls.

A generally conical-in-configuration guide member 82, shown in FIGS. 3, 4 and other Figs., is the primary ball feed mechanism; it has a generally conical top wall 84 and cylindrical, generally vertical side walls 86 integral therewith. When lid 12 is removed to charge hopper 14 with golf balls, the balls are distributed radially outwardly by said conical top wall 84 and said balls enter the vicinity of the rotating turntable 62 when they drop off of said guide member, as indicated by the directional arrows appearing in FIG. 3. Guide member 82 also shields turntable 62 from the weight of balls in the hopper. As will be set forth hereinafter, only a few balls at a time can gain access to the turntable, thereby insuring that it will always be freely rotatable.

Opposed, downwardly inclined shelf members 87, 88 also form a part of the feed and anti-jamming mechanism. The shelves 87, 88 initially direct balls deposited thereatop onto the conical top wall 84 of guide member 82 as indicated by the aforementioned directional arrows in FIG. 3. The lowermost edge of each shelf is above top 84 of guide member 82, and said lowermost edges are spaced thereabove by a distance greater than the diameter of golf ball. As the charging of the hopper 14 continues, and the balls begin to accumulate atop the shelves, two interesting phenomena become manifest. First, the shelves 87, 88 support the weight of the balls deposited thereatop, thereby keeping said weight from affecting balls near the bottom of the hopper in the vicinity of the turntable and thereby reducing the probability that a jam might occur. Secondly, the shelves define an air space 89, 90 therebelow into which the balls cannot enter. Thus, the shelves serve to limit the maximum depth of the balls so that the weight bearing down on the lowermost balls in the hopper is maintained below the jamming threshold.

Figures 11, 11A:
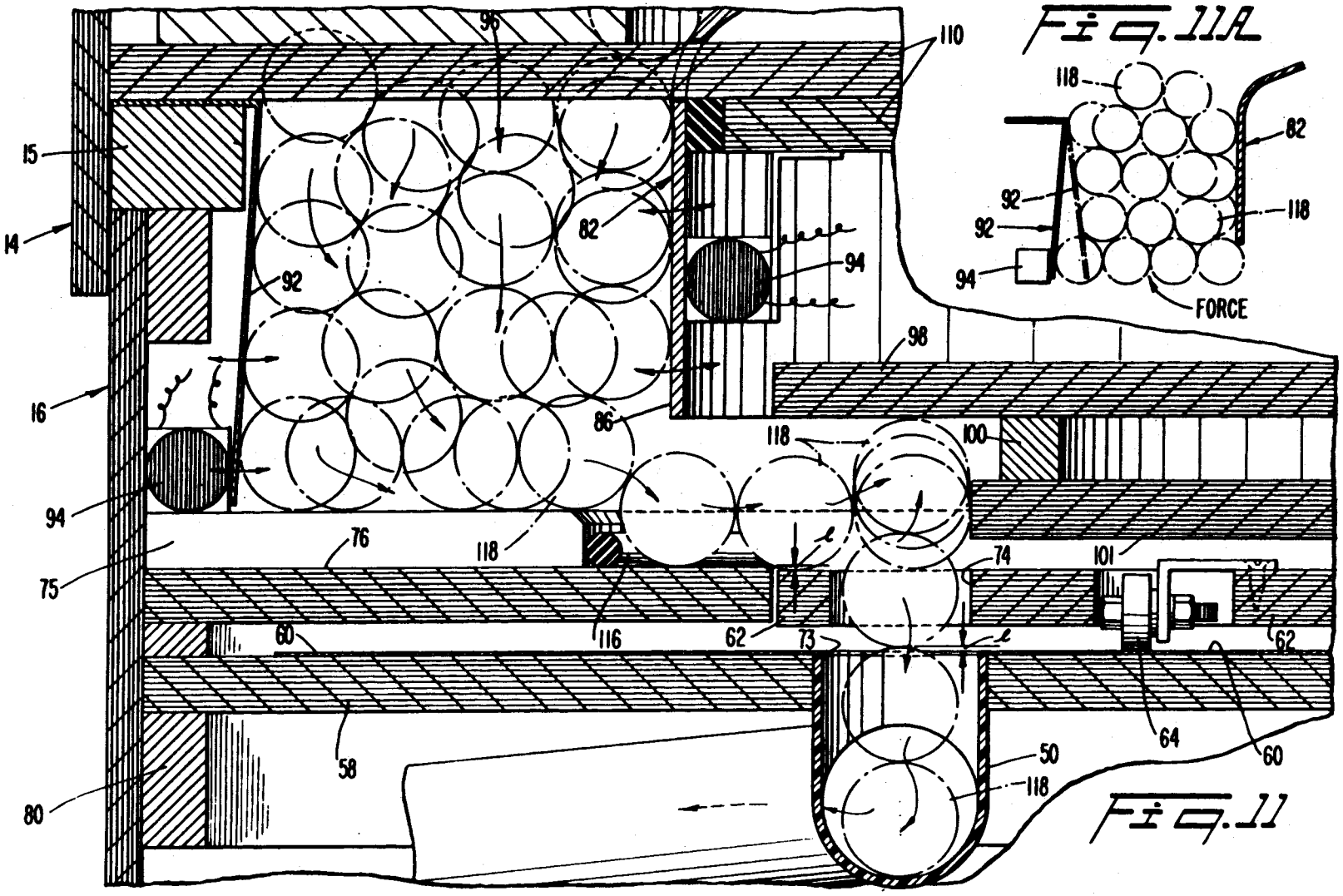
FIG. 11 is a detailed view of the lower part of the hopper where the golf balls enter the uppermost end of the fill tube.
FIG. 11A is a detailed view showing the preferred orientation of the vibratable metal plates that are positioned about the periphery of the hopper.

A flexible metal plate 92, shown in FIG. 11 and other Figs., is formed of several sections and circumscribes the hopper 14 near the bottom thereof and forms still another part of the feeding and anti-jamming means. In FIG. 11, plate 92 is shown sloped outwardly relative to the center of the hopper and that position is operable but the walls 92 should be sloped toward the center of the hopper to further prevent jamming as depicted in phantom lines in FIG. 11A. Plates 92 are fastened at the top only, to enhance their vibration. As shown in FIG. 11A, when plates 92 are sloped toward the center of the machine, an inverted pyramid of golf balls 118 is formed, whereas a jam-inducing pyramid may be formed if plates 92 are sloped away from the center, as clearly depicted in FIG. 11A A plurality of vibrator means 94 are positioned at pre-selected locations within the hopper and the vibrator means abuttingly engage the flexible metal plates 92 and vertical side walls 86 of guide member 82 as shown in FIGS. 11, 11A, and other Figs. Thus, activation of the vibrator means effects vibration of the flexible metal plates and the guide member side walls 86. As is clear from FIGS. 3, 4 and 11, the vibration of plates 92 and the side walls 86 is transferred to the balls in space 96 in the vicinity of escape aperture 73, further insuring against jamming.

Closure plate 98, shown in FIG. 11 and other Figs., closes the bottom of the weight-saving hollow guide member 82 to prevent balls from getting thereunder and as such serves as a further anti-jamming means.

Round or square stop box spacer member 100 and round stop plate or disc 101 are disposed in sandwiched relation between the closure plate 98 and the turntable 62; they abut the former and are spaced upwardly from the latter and prevent balls from getting radially inwardly of the apertures 74 formed in turntable 62 as best understood in connection with FIGS. 7 and 11. Thus, they cooperate with guide member 82 to keep the weight of the balls in the hopper off turntable 62 so that it may rotate freely. Either member 100, 101 could be of round configuration. If round, stop plate 101 would have a diameter equal to the diameter of an imaginary circle connecting the radially innermost edges of apertures 74.

Figure 5:
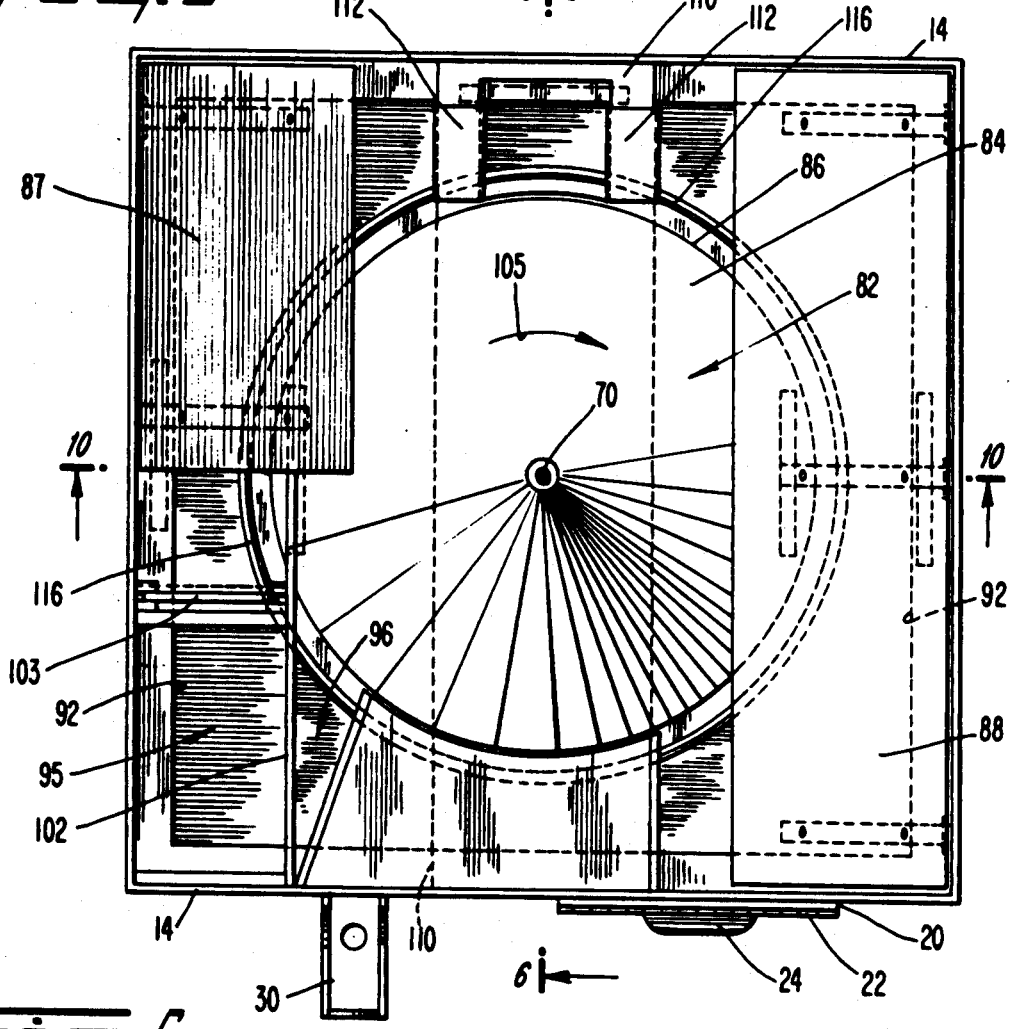
FIG. 5 is a sectional view taken along line 5—5 in FIG. 3.

Reference numeral 102 in FIG. 5 generally denotes still another anti-jamming means; it is a rectangular enclosure, as shown, that includes a vertically disposed, slideably mounted gate 103 that is placed into the position shown in FIGS. 3 and 5 when the hopper 14 is empty and about to be charged with balls. With gate 103 in position, balls cannot initially enter the confines 95 of the enclosure or space 96 in the vicinity of escape aperture 73.

Crank 104 in FIG. 3 is employed by authorized personnel only when balls are initially charged into hopper 14; it permits the individual charging the balls into the hopper to rotate the turntable as needed to prepare the machine for fully automated operation.

The individual who employs crank 104 is the same individual who inserts gate 103 at the beginning of the ball charging procedure. Once the balls have been charged, gate 103 is removed and crank 104 is rotated a few times to fill pipe 46 and the apertures 74 in turntable 62, and lid 12 is swung about its hinges to close hopper 14 and the machine 10 is ready for use by consumers.

The function performed by gate 103 is considered quite critical to the functioning of the machine. Since gate 103 initially bars entry of balls into the space 95 enclosed by gate 103, it is important to note that when said gate 103 is removed and stored under lid 12, (which removal takes place only when the hopper has been filled), only a few balls will roll into space 95, and those balls will be substantially in a single layer. Thus, there will be an area in the vicinity of gate 103 when said gate is removed where a transition exists between the main hopper where the balls are stacked in many layers atop one another and in the space near the escape aperture 73 where the balls are single layered or at least substantially single layered. Thus, as the machine operates, the transition area will remain in existence, although it will tend to move in a clockwise direction as the hopper gradually empties. Since gate 103 and the confined space 95 are spaced, in a clockwise direction, from escape aperture 73, the balls in the hopper will travel, primarily, in a counterclockwise direction when approaching the escape aperture. Turntable 62 rotates in a clockwise direction, as denoted by directional arrow 105 in FIG. 5, when motor 66 is running which is advantageous because a counterclockwise rotation would place some pressure on the balls in the direction of the escape aperture 73.

A bracket, not shown, affixed to the underside of lid 12, holds gate 103 and crank 104 when said items are not in use. This convenient storage location insures that said items will not be lost and will be readily available when needed.

As shown in FIG. 3, shelf 88 is releaseably mounted on bracket 91, in keeping with the design criteria that machine 10 be assembleable and disassembleable without tools. A similar bracket supports shelf 87.

FIGS. 3 and 4 also show a suitable support structure, generally denoted 106, for motor 66.

Figure 10:
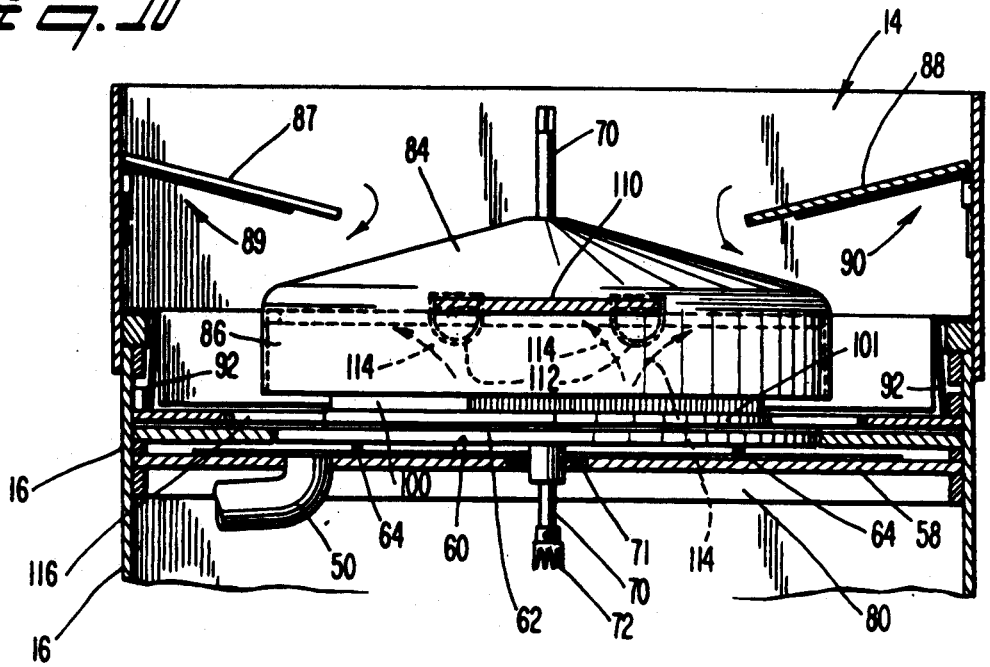
FIG. 10 is a sectional view taken along line 10—10 in FIG. 5.

Guide member 82 is supported by a bridge-like member 110 shown in FIGS. 5 and other Figs. As perhaps best shown in FIGS. 4 and 10, convex surfaces 112, 112 deflect golf balls thereunder away from said surfaces as suggested by arrows 114, thereby providing still another anti-jamming means. It is perhaps best understood in connection with FIG. 11 that it is bridge member 110 that suspendingly carries guide 82 and maintains the spatial relationship between stop plate 101 and turntable 62 so that said turntable may rotate freely.

FIG. 11 also shows a large elastomeric "O"-ring 116 that circumscribes the floor of hopper 14 at the base of the sloping floorboards 75, 77. Ring 116 is cut where floor boards 75, 77 meet, i.e., it is actually formed by a pair of confronting "C"-shaped halves. The ring 116 provides, in effect, a resilient step that further prevents golf balls from jamming at the edge of the floorboards 75 or 77. As best shown in FIG. 7, ring 116 is clamped to floorboards 75, 77 by a plurality of circumferentially and equidistantly spaced clamps, collectively denoted 117.

A very subtle anti-jamming means is also shown in FIG. 11. The length of pipe 46 is very precisely predetermined so that when it is full of golf balls 118, the uppermost ball in pipe 46 will project slightly upwardly above bearing plate 60 as indicated both graphically and by the confronting arrows positioned just to the left of a turntable bearing 64 in FIG. 11. Accordingly, as turntable 62 rotates, if pipe 46 is full, which condition is depicted in FIG. 11, the balls 118 carried in their respective apertures 74 will not be able to fall through escape aperture 73 into the fully occupied pipe. Due to the protrusion of the upper surface of the top ball in the pipe above the plane of escape aperture 73, each ball in its turntable aperture 74 is transiently displaced upwardly by such protrusion as it passes thereover, i.e., the uppermost ball in the fill tube provides a bump in the path of travel of the balls carried by the turntable 62 and such bumping jostles all of the balls in the vicinity of the escape aperture 73, thereby assuring that the balls will not jam even when the pipe is full so that as soon as the machine vends balls to a customer, balls from the hopper will immediately refill the pipe 46.

Turntable 62 is also spaced downwardly from floorboards 75, 76 by the same small distance as indicated by the second set of confronting arrows where said floorboards and turntable 62 meet. This downward step provides a slight gravity feed toward the turntable.

A further clarification of this novel jostling means is provided in FIG. 12. Since the turntable 62 rotates about six times per minute in a contemplated commercial embodiment and since apertures 74 are rather closely spaced to one another, balls carried by the turntable will pass rather rapidly over the protruding uppermost ball and the amount of anti-jamming action thereby provided is substantial.

FIG. 13 provides a view of the earlier-mentioned split "O"-ring 116 when floorboards 75, 77 are not tilted, i.e., when spacers held by locator pins 78 are not employed, and FIG. 14 shows the sloping configuration of the floorboards. "O"-ring 116 has utility as an anti-jamming means in both configurations.

FIG. 15 depicts the preferred electrical circuitry that controls the operation of machine 10. Circuit 120 is protected by fuses 122, 124 and is disabled by open switch 44 if no bucket 38 is in bucket chamber 40. Similarly, the machine cannot operate until momentary switch 31 has been closed by coin or token-accepting slide member 30.

The operation of motor 66 is controlled by motor timer 128; the preferred timer is a general purpose, knob adjustable, timing relay of the "off-delay" type such as a Class 9050 Type JCK timing relay available from Square D Company and other vendors. The preferred relay is the JCK-25 timing relay which has an off-delay adjustable between 1.8 to 180 seconds. In a contemplated commercial embodiment of the invention, timing relay 128 is set at a 60 seconds off delay so that turntable 62 begins rotation upon coin or token activation of the machine and stops rotating 60 seconds thereafter.

Normally closed switches 130 and 132 are under the control of the timing relay 128; switch 130 disables motor 66 when opened by the timer as is obvious from an inspection of FIG. 15, and switch 132, when open, disables switch 31 so that slide 30 cannot accept additional coins or tokens while the turntable 62 is rotating.

Timing relay 134 controls the opening of normally closed switch 136; switch 136 in turn controls the activation of the vibrators 94 and the pipe gates 54, 56. The preferred timing relay 134 is a JCK-23 off-delay type timing relay having a knob-adjustable timing range between 0.6 to 60 seconds. In a commercial embodiment of the invention the pipe gates 54, 56 are held open for about six seconds each time they are activated.

In the JCK-25, mentioned earlier, and the JCK-23, control power is applied continuously. When the control switch is closed, the output contacts energize; reopening the control switch begins the time delay. At the end of the time delay, the output contacts de-energize.

Figure 19:
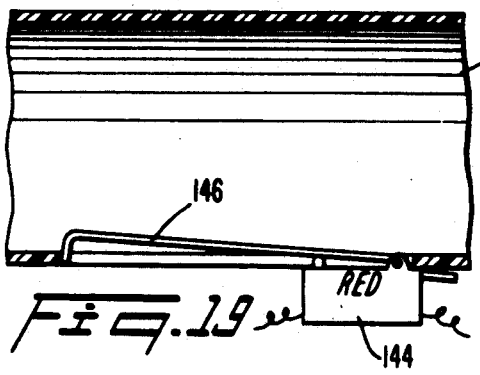
FIG. 19 is a sectional view of a part of the fill tube when empty.
Figure 20:
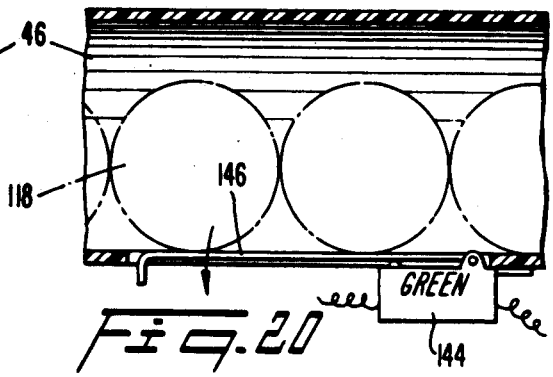
FIG. 20 is a view similar to FIG. 19, but showing that section of the pipe when it is full.

The timing relays 128, 134 are under the control of general purpose control relay 138. A suitable control relay is a Type RS-14 relay available from Square D Company, selected from the Class 8501, Type R family of relays. Control relay 13 is conductively coupled to the plural vibrators 94, pipe gates or solenoids 54, 56 and to motor 66 through capacitors 140, 142 as shown. Accordingly, micro switch 144 and its upwardly biased lever arm 146, shown in FIGS. 19 and 20, is not needed to activate red lamp 28 when pipe 46 is empty (FIG. 19) or to activate green lamp 26 when pipe 46 is full of balls 118 (FIG. 20), but the use of such switching means for the control of said lamps is a viable option. It should be understood that switch 144 is located at the very uppermost end of the fill tube 46, directly below escape aperture 73.

Figure 16:
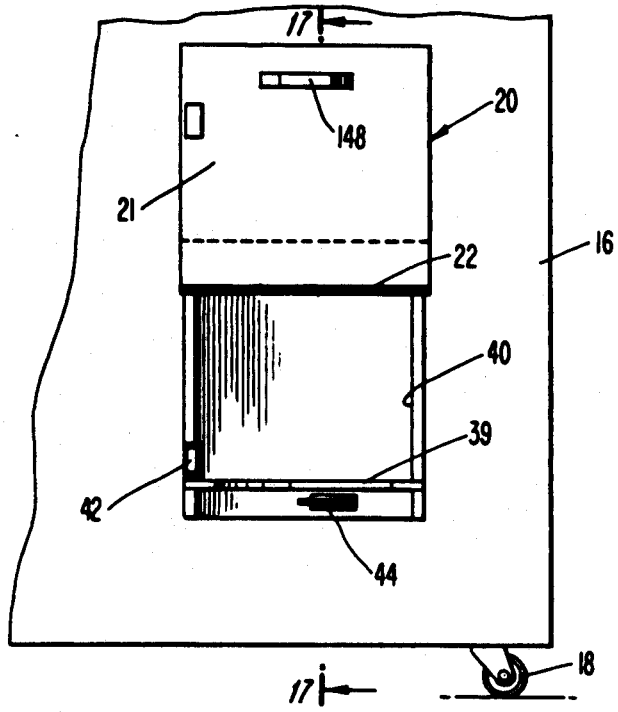
FIG. 16 is a frontal view of the bucket chamber with the door open.
Figure 17:
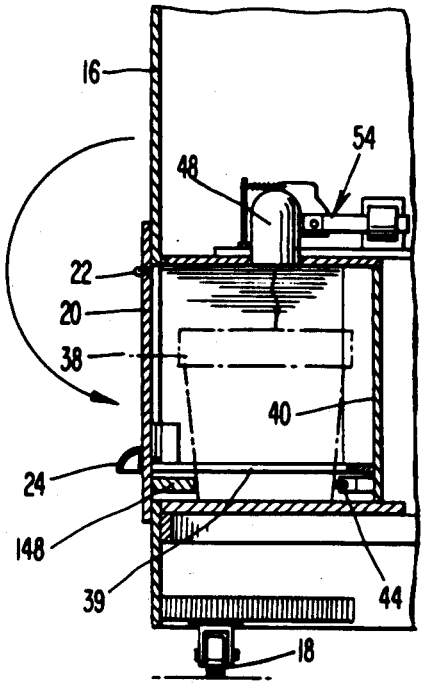
FIG. 17 is a sectional view taken along line 17—17 in FIG. 16.

FIGS. 16 and 17 show the earlier-mentioned means for insuring that bucket 38 is fully disposed within chamber 40 before machine 10 can be operated. A rigid protuberance 148 is fixedly secured to the interior surface 21 of door 20 so that when the door is closed as depicted in FIG. 17, protuberance 148 shoves bucket 38 fully into chamber 40. This insures the closing of bucket limit switch 44 as depicted in FIG. 17. A guide member 39 centers bucket 38 with its chamber 40; the guide 39 is wide at its forward end and coverages toward a bight region where limit switch 44 is located.

Figure 18:
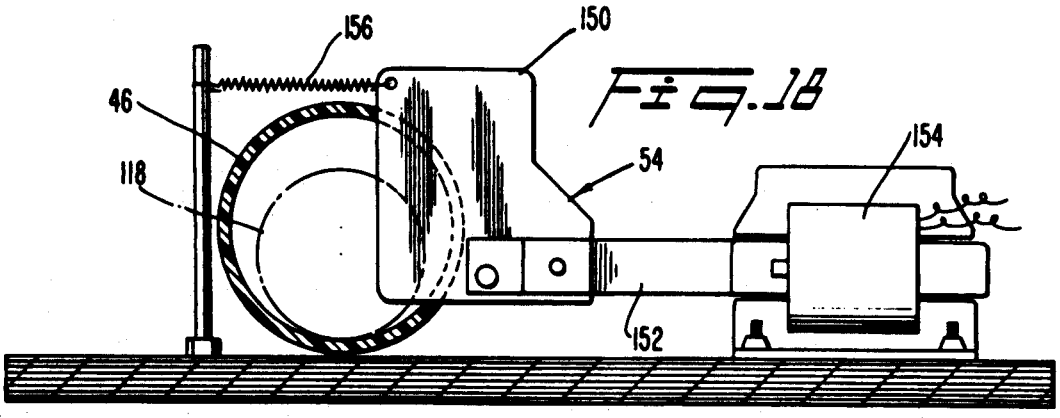
FIG. 18 is a detailed view of the preferred embodiment of the gate that blocks the flow of the golf balls through the fill tube when closed.

A more detailed view of pipe gates 54 or 56 is provided in FIG. 18. Pipe 46 is slotted to at least partially admit a flat plate 150 fixedly secured to the distal free end of a plunger 152 of a solenoid 154. When the coils of solenoid 154 are energized, plunger 152 is pulled axially thereinto, thereby withdrawing plate 150 from the slot and allowing golf balls 118 to roll through pipe 46 under the influence of gravity. When solenoid 154 is de-energized, spring 156 or other suitable bias means returns plate 150 to its depicted equilibrium position, thereby again blocking the pipe as shown. In a contemplated commerical embodiment, all of the solenoids are push or pull type solenoids, stock number 4X897, sold under the trademark Dormeyer.

Multiple, longitudinally spaced slots 47 (FIG. 3) are provided at five ball increments and are labeled as shown so that upper gate 56 can be moved to change the amount of balls dispensed when lower gate 54 opens. Suitable pre-drilled holes are provided to facilitate re-positioning of the gate 56 and its associated parts.

When slide 30 accepts a first coin or token, motor 66 begins turning turntable 62 as aforesaid and pipe gate 54 opens, thereby admitting all of the golf balls downstream from gate 56 into bucket 38. The length of pipe 46 is specifically predetermined so that the number of balls upstream of gate 54 is equal to the number of balls required to fill a small bucket, since many driving range patrons desire to purchase only a half bucket of balls. Gate 54 remains open preferably for about six seconds, as mentioned earlier, since it takes two or three seconds for the balls upstream of said gate to roll into bucket 38. At the elapse of said six seconds, or other preselected period of time, gate 54 closes and gate 56 opens to refill the upper end of pipe 46. If the customer desires a full or large bucket of golf balls, he or she deposits another coin or token into slide 30 and the above-described procedure repeats to fill the bucket.

Bucket 38 is shown in more detail in FIGS. 21–25 and has several unique features. Internally projecting ribs 39 provide an important anti-stick feature, i.e., ribs 39 allow a plurality of buckets 38 to be nested together without sticking together.

Bucket 38 includes an outwardly turned annual flange 158 having upstanding cylindrical side walls 160 projecting upwardly therefrom. Accordingly when bail 162 is folded downwardly into its stored position, it overlies interior ledge 164 formed by said annual flange 158. Thus, unlike conventional buckets, having externally mounted bails, bail 162 is mounted internally.

Bail 162 is of resilient metallic construction. Since bucket 38 may be quite heavy when full, opposite ends 166, 168 of bail 162 will tend to converge when the bucket is lifted; accordingly, said opposite ends are rotatably mounted to diametrically opposed mounting members 170, 172 which are of frusto-conical configuration as perhaps best shown in FIGS. 24 and 25. The wider part of each mounting member 170, 172 is positioned toward the center of the bucket as shown. Thus, the opposite ends of the bail are cammingly driven radially outwardly to prevent disengagement of the bail from the bucket when the bucket is lifted as is perhaps best understood by comparing FIGS. 24 and 25. FIG. 24 shows the bail 162 when it is in its stored configuration, and FIG. 25 shows the bail when it is supporting the weight of a bucket that is at least half full. It will be noted that the frusto-conical surfaces of the mounting member 172 has driven the opposite ends 166, 168 of the bail apart from one another, as shown in FIG. 25.

A difficult to see in the drawings but important feature of the bucket assembly includes a small nub 174 that rides in "V"-shaped groove 176 when the handle or bail is down and that rides in "V"-shaped groove 178 when the bail is up. The nub and groove combination maintain the handle in either its up or down configuration.

Another means for maintaining the bail in either of its two primary positions is shown in FIGS. 26–28. In this embodiment, each end of the bail terminates in a "D"-shaped configuration having an arcuate part 180 and a straight part 182 as shown in FIG. 26. Each mounting member 170, 172 has a groove 184 formed in its bottom as depicted in FIG. 6; each groove 184 receives straight part 182 of its associated "D"shaped bail end when the bail is in its up position, and that interlocking of parts maintains the bail in said up position. When the bail is in its lowered position, straight part 182 exits groove 184 and rides against the circular outer surface of the bail. The breadth of the "D"-shaped section is less than the diameter of mounting members 170, 172 so that when the bail is rotated to its down position, the difference in diameters effects a frictional engagement between the parts, thereby holding the handle down.

Several clamps and other miscellaneous minor structural features of the novel assembly are shown in the drawings but have not been specifically pointed out and numbered to avoid unduly lengthening this disclosure. Again, those skilled in the art of machine design could make numerous changes to the structure shown and described herein, in view of this disclosure, and all of such changes are of course included within the scope of this invention.

For example, the machine could have a cylindrical or other predetermined geometrical shape. Moreover, it could be made of steel, aluminum, plastic, wood, or other suitable material.

Machine 10 includes breakthrough technology in the field of this invention and as such it pioneers the art of golf ball vending machines. The claims that follow are therefore to be interpreted broadly so as to protect the heart or essence of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A machine for vending golf balls, comprising:

a hopper for holding a large plurality of golf balls;

an escape aperture formed in a floor of said hopper;

delivery means for sequentially delivering golf balls, one at a time, to said escape aperture;

said delivery means including a rotatable mounted turntable having a plurality of ball-receiving apertures formed therein and rotating means for rotating said turntable, said turntable and said apertures formed therein being specifically positioned within said hopper so that said apertures sequentially pass over said escape aperture as said turntable rotates;

a pipe having an upper end in an open communication with said escape aperture so that a golf ball received within a turntable aperture falls under the influence of gravity into said pipe upper end when said turntable aperture passes over said escape aperture;

a bucket chamber disposed below said hopper;

said pipe having a lower end in open communication with said bucket chamber;

a first gate operative to close said pipe to travel of golf balls therethrough when said gate is closed and operative to open said pipe to travel of said golf balls therethrough when said gate is open;

said first gate positioned near a lower end of said pipe;

a second gate positioned about mid-way between the upper end of the pipe and the lower end of the pipe;

said pipe following a generally spiral downward path of travel; and control means for selectively opening and closing said first and second gates in a predetermined sequence.

2. The machine of claim 1, further comprising a plurality of circumferentially spaced bearing members that support said turntable and enable facile rotation of said turntable in a substantially horizontal plane.

3. The machine of claim 2, wherein said turntable and said hopper floor are substantially coplanar with one another.

4. The machine of claim 3, wherein said hopper floor is disposed in surrounding relation to said turntable and is sloped toward said turntable so that balls supported by said hopper floor are urged by gravity toward said turntable.

5. The machine of claim 4, further comprising a ball guide means disposed in said hopper in vertically spaced relation to said turntable for guiding the balls introduced into said hopper radially outwardly of said turntable.

6. The machine of claim 5, wherein said ball guide means is a generally conical guide member having a downwardly sloping top wall and cylindrical, vertical side walls depending therefrom about the periphery thereof.

7. The machine of claim 6, wherein said guide member has a predetermined diameter greater than the diameter of said turntable so that golf balls dropping off said downwardly sloping top wall are deposited radially outwardly of said turntable.

8. The machine of claim 7, wherein said guide member is hollow and has an open bottom to reduce the weight of said machine and further comprising a closure plate member positioned substantially coplanar with said open bottom to bar entry of golf balls into the space within said guide member.

9. The machine of claim 8, further comprising stop means for preventing entry of golf balls radially inwardly of the apertures formed in said turntable.

10. The machine of claim 9, wherein said stop means includes a flat stop plate member fixedly secured to the bottom of said closure plate member, said flat stop plate member being disposed in closely vertically spaced relation above said turntable to allow rotation of said turntable and to bar travel of golf balls radially inwardly of said apertures.

11. The machine of claim 10, further comprising a machine housing positioned below said hopper and a generally horizontal partition wall member disposed at the top of said housing to separate said housing and said hopper, said escape aperture also being formed in said partition wall member.

12. The machine of claim 11, further comprising a motor disposed in said housing, said motor having an output shaft, and said output shaft being coupled to said turntable so that operation of said motor effects rotation of said turntable.

13. The machine of claim 12, further comprising vibrating means for vibrating the balls in said hopper to prevent them from jamming.

14. The machine of claim 13, further comprising a flexible border wall member mounted substantially about the periphery of said hopper and at least one vibrator member secured to said flexible border wall member so that activation of said vibrator member effects vibration of said border wall member and hence creates a jostling action among golf balls filling said hopper that prevents them from jamming.

15. The machine of claim 14, further comprising at least a second vibrator member fixedly secured to said guide member, interiorly thereof.

16. The machine of claim 15, further comprising at least one downwardly sloping shelf member secured to a side wall of said hopper, said at least one shelf member having a lowermost edge spaced vertically upwardly of said guide member so that balls rolling off said shelf are directed onto said guide member, said at least one shelf member supporting the weight of golf balls disposed thereatop when said hopper is substantially full and said at least one shelf member defining an air space therebelow into which balls cannot enter so that the maximum depth of golf balls in said hopper is thereby limited.

17. The machine of claim 16, further comprising an enclosure in the vicinity of said escape aperture to bar golf balls initially charged into said hopper from initially entering the vicinity of said escape aperture.

18. The machine of claim 17, further comprising a gate formed in said enclosure so that after balls have been initially charged into said hopper and said turntable has been initially rotated to clear the escape aperture vicinity, then said gate is removed.

19. The machine of claim 18, further comprising a bridge member having opposite ends supported by sidewalls of said hopper, said guide member being suspendedly supported by said bridge member about mid-length thereof, and said bridge member having rounded surfaces on its lower side to deflect golf balls disposed thereunder when pressing upwardly thereagainst so that said balls are not jammed thereby.

20. The machine of claim 19, further comprising a bearing plate member that overlies and is supported by said partition wall, said turntable bearing members riding atop said bearing plate member and said escape aperture also being formed in said bearing plate member.

21. The machine of claim 20, further comprising a bucket disposed in said bucket chamber and deactivating means for deactivating said machine if said bucket is not fully positioned within said bucket chamber.

22. The machine of claim 21, wherein said deactivating means includes a normally open switch disposed in an electrical circuit that includes said motor and said control means, and wherein said normally open switch is closed to complete said circuit only when said bucket is fully positioned within said bucket chamber.

23. The machine of claim 22, further comprising a hingedly mounted door for closing said bucket chamber, and further comprising a protuberance fixedly secured to an inner surface of said door so that said protuberance bears against said bucket when said bucket is positioned within said bucket chamber and drives said bucket rearwardly into said chamber, said normally open switch being positioned in a rearward part of said bucket chamber and being closed by said bucket when said bucket is driven thereinto by said protuberance when said door is closed.

24. The machine of claim 23, wherein said bucket has a bottom wall, side walls mounted about the periphery thereof and projecting upwardly therefrom, a horizontally disposed, radially outwardly extending flange integral with an upper rim of said walls, and upwardly extending walls mounted about the periphery of said flange.

25. The machine of claim 24, further comprising a pair of bail mounting members of frusto-conical configuration being formed on diametrically opposed inner surfaces of said upwardly extending walls, and further comprising a bail having its opposite ends rotatably secured to said mounting members so that when said bail is not in use, it is stored in folded configuration in overlying relation to said flange, interiorly thereof.

26. The machine of claim 25, wherein a wide end of each frusto-conical mounting member is radially inward of a narrow end thereof so that said mounting members cammingly drive opposite ends of said bail in a radially outward direction when said bail is operatively employed to lift said bucket.

27. The machine of claim 24, further comprising a bail member pivotally secured to said bucket and further comprising frictional engagement means for maintaining said bail in its substantially vertical, operative position and in its folded, non-operative position.

28. The machine of claim 27, wherein said bail member is internally mounted and overlies said flange when in its folded, non-operative position.

29. The machine of claim 28, further comprising a plurality of circumferentially spaced, radially inwardly extending anti-stick rib members formed on an internal surface of said bucket side walls.

30. The machine of claim 1, wherein said predetermined sequence begins with said pipe full of golf balls and with said first gate closed and said second gate open.

31. The machine of claim 30, wherein said rotating means is a motor means, said machine further comprising activating means for activating said motor means, said activating means being activated by coin means, said coin means including coins, tokens, and paper money.

32. A vending machine that vends a predetermined amount of golf balls when activated, comprising:

an upstanding, generally hollow housing member;

a hopper means, for holding a large plurality of golf balls, being disposed in surmounting relation to said housing member;

a turntable being rotatable mounted in said hopper means;

a plurality of equidistantly and circumstantially spaced apertures means being formed in said turntable, each of said aperture means being specifically dimensioned to receive one golf ball at a time;

a guide means positioned above said turntable and above a floor of said hopper means for directing golf balls disposed in said hopper means into said aperture means;

an elongate pipe having a first end in intermittent open communication with each of said aperture means, on a sequential basis, as said turntable rotates so that a golf ball disposed within an aperture means drops into said pipe as said aperture means travels over said first end;

a bucket chamber disposed near the bottom of said housing member;

said pipe having a lower end disposed in open communication to said bucket chamber;

whereby a golf ball exits said hopper means through an aperture means formed in said turntable when said turntable carries said ball over said first end of said pipe;

whereby said pipe carries said ball to said bucket chamber and;

a first gate being positioned at a first predetermined position along the extent of said pipe;

said first gate having an open position where a golf ball traveling therepast is unimpeded thereby and having a closed position that prevents a golf ball from traveling therepast; and a second gate being positioned at a second predetermined position along the extent of said pipe, said second gate having an open position where a golf ball traveling therepast is unimpeded thereby and having a closed position that prevents a golf ball traveling therepast.

33. The machine of claim 32, wherein said guide means includes a generally conical guide member disposed substantially centrally of said hopper means, said guide member having a downwardly sloping top wall that directs golf balls disposed thereatop downwardly and radially outwardly with respect to the center of said guide member.

34. The machine of claim 33, wherein said guide member has a generally vertical, circumferentially extending side wall integral with said top wall so that golf balls rolling off said top wall fall downwardly toward a floor of said hopper means upon reaching an outer peripheral edge of said top wall.

35. The machine of claim 34, wherein said guide member has a predetermined diameter greater than a predetermined diameter of said turntable, and wherein a lowermost annular edge of said guide member side wall has a lowermost annular edge disposed a predetermined distance above said turntable, said predetermined distance being greater than a golf ball diameter so that a golf ball may travel under said lowermost annular edge and enter into an aperture means formed in said turntable.

36. The machine of claim 35, further comprising a closure plate member disposed at the bottom of said guide member to prevent balls traveling under said lowermost annular edge of said guide member side wall from entering into a space under said guide member top wall.

37. The machine of claim 36, further comprising a stop plate means of predetermined diameter, said stop plate means being disposed between said closure plate member and said turntable to prevent balls atop said turntable from traveling radially inwardly past the aperture means formed in said turntable, said stop plate means having a predetermined diameter substantially equal to the diameter of an imaginary circle that interconnects the radially innermost edges of the aperture means formed in said turntable.

38. The machine of claim 37, further comprising a motor for rotating said turntable at a predetermined rate, said motor being disposed within said housing member, below said hopper means.

39. The machine of claim 38, further comprising a pair of downwardly inclined shelf members releaseably secured to opposing preselected side walls of said hopper means at a preselected position thereon, each of said shelf members having a lowermost edge disposed above said guide member top wall by a predetermined distance greater than the diameter of a golf ball, whereby golf balls introduced into said hopper means are directed onto the top of said conical member by said shelf members and whereby the downward slope of said shelf members defines an air space under said shelves into which golf balls may not enter and whereby said shelves support the weight of golf balls disposed thereatop to help prevent jamming of golf balls disposed therebelow.

40. The machine of claim 39, further comprising anti-jamming means to inhibit ball jamming, said anti-jamming means including a flexible, generally upstanding wall member disposed in surrounding relation to said hopper means and vibrator means connected to said flexible wall member so that said wall member vibrates when said vibrator means is activated.

41. The machine of claim 40, wherein said pipe is elongate and has a generally spiral mid-section that interconnects said uppermost and said lowermost parts so that a large plurality of golf balls occupies said pipe in a long queue when said pipe is full of golf balls.

42. The machine of claim 41, further comprising control means for opening and closing said first and second gates in accordance with a predetermined sequence.

43. The machine of claim 42, wherein said turntable means is rotatably supported by a plurality of circumferentially spaced bearing members, and further comprising a bearing plate member disposed below said turntable means in vertically spaced relation thereto, said bearing members being supported by said bearing plate member.

44. The machine of claim 43, wherein said bucket chamber is configured and dimensioned to receive a bucket therein, and further comprising a bucket switch means positioned in said bucket chamber that deactivates said machine when said bucket is not disposed in said chamber and that enables the activation of said machine when said bucket is positioned in said chamber.

45. The machine of claim 44, further comprising means for insuring that said bucket switch means is closed when said bucket is positioned within said chamber, said means including a hingedly mounted door member for closing said chamber and a protruding block member fixedly secured to an inside surface of said door member that abuts said bucket when said door member is closed, said block member urging said bucket into activating relation to said bucket switch means when said door member is closed.

46. The machine of claim 45, further comprising a bail member pivotally secured to said bucket and further comprising frictional engagement means for maintaining said bail in its substantially vertical, operative position and in its folded, non-operative position.

* * * * *